US005398924A

United States Patent [19]

Hiltwein et al.

[11] Patent Number: 5,398,924

[45] Date of Patent: Mar. 21, 1995

[54] SENSOR FOR CYCLICALLY SCANNING THE HEIGHT OF A PILE

[75] Inventors: Hans-Peter Hiltwein, Waghäusel; Jochen Renner, Heidelberg, both of Germany

[73] Assignee: Heidelberger Druckmaschinen AG, Heidelberg, Germany

[21] Appl. No.: 227,593

[22] Filed: Apr. 14, 1994

[30] Foreign Application Priority Data

Apr. 14, 1993 [DE] Germany ..... 43 12 228.0

[51] Int. Cl.[6] ..... B65H 1/16

[52] U.S. Cl. ..... 271/154; 271/152; 271/103

[58] Field of Search ..... 271/152, 154, 155, 156, 271/265, 103, 104, 105

[56] References Cited

U.S. PATENT DOCUMENTS 3,306,607 2/1967 Schwebel ..... 271/154
4,786,043 11/1988 Jiruse et al. .
5,052,672 10/1991 Hotii ..... 271/152
5,094,439 3/1992 Renner et al. .

FOREIGN PATENT DOCUMENTS 498411 5/1930 Germany .
824954 11/1951 Germany .
6932184 8/1969 Germany .
3218565 11/1983 Germany .
4012779 5/1991 Germany .
4009175 9/1991 Germany .
441225 8/1974 U.S.S.R. .

*Primary Examiner*—H. Grant Skaggs
*Attorney, Agent, or Firm*—Herbert L. Lerner; Laurence A. Greenberg

[57] ABSTRACT

A feeler for cyclically sensing the pile height of a feed pile in a sheet-fed machine, in particular a printing machine, having a lever drive linkage with a sensing roller, which at least during paper travel is in constant touch contact by means of a spring with a cyclically drivable drive cam; having a four-bar guide linkage with two levers, disposed one above the other and each with one end pivotally supported on the frame, which levers are each pivotally supported by their other lever end, spaced apart from one another, on a coupler, wherein a feeler foot for sensing the pile height is secured to a downward-extending vertical extension of the coupler; having a carrier stop, which is secured to the drive linkage; having a stop face on the guide linkage, which face is embodied and disposed in a fashion corresponding to the carrier stop for cyclically establishing touch contact for raising the feeler foot; and having a spring, one spring support of which is secured in a manner fixed to the machine and whose other spring support is secured to the guide linkage, and whose spring force presses the stop face in the direction toward the carrier stop.

8 Claims, 4 Drawing Sheets

SENSOR FOR CYCLICALLY SCANNING THE HEIGHT OF A PILE

Figure 2:
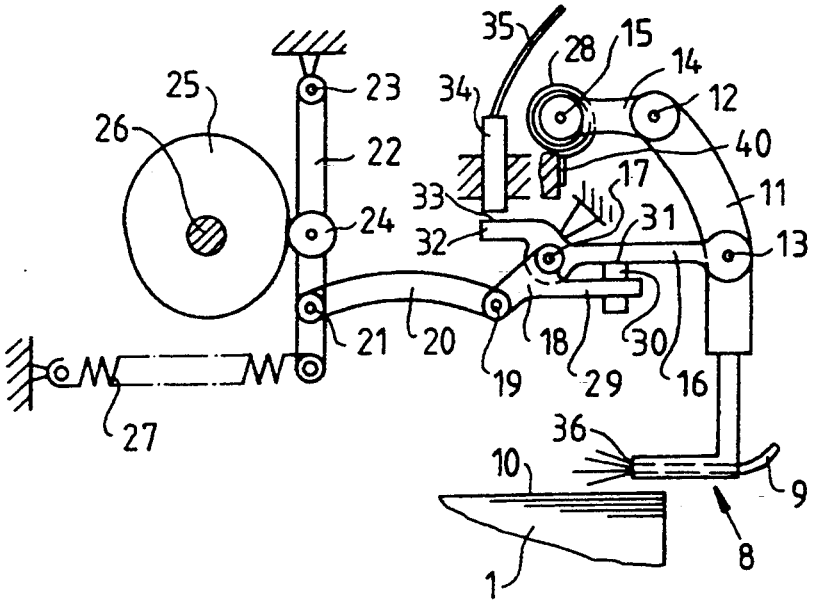

The invention relates to a sensor or feeler for cyclically scanning the height of a feeder pile of a paper sheet processing machine, such as a printing press, especially. German Published Non-Prosecuted Patent Application (DE-OS) 40 09 175 discloses a sensor which, via a four-bar linkage guide transmission which is rigidly connected with a four-bar linkage drive transmission which, in turn, is controlled by a cam drive, is lowered to a surface of a sheet pile for cyclically sensing or scanning the sheet pile and is again lifted for releasing the upper paper sheet after the pile height has been sensed, for acceptance or take-over of the paper sheet by downline suckers. With such a double four-bar linkage drive, all of the inertial forces of both four-bar linkages act when the governor foot is lowered. After the governor foot has been seated upon the upper paper sheet of the pile, this paper sheet, for one thing, because of the high inertial forces of both four-bar linkage drives and, for another thing, due also to the somewhat farther downwardly extending drive, is pressed with great, further driving forces against the upper paper sheet via the contact point of the governor foot with the upper paper sheet, which is required for a reliable measurement. The upper paper sheets can thereby be deformed with corrugations or ripples, due to which a reliable sheet acceptance and conveyance of the paper sheet after acceptance or pick-up by the lifting suckers, especially at high speeds, is endangered. The lifted paper sheets are usually accepted or picked up by pull suckers from the lifting suckers and conveyed over leading edge stops of the sheet pile. A rippled or corrugated formation in the paper sheet can result, for one thing, in stumbling or halting phenomena of the paper sheet during conveyance thereof, for example, over the leading edge stops and, for another thing, facilitates the non-uniform or irregular rippling or corrugations as well as an irregular underflow of the sheet, especially when using portable air blowers, due to which fluttering phenomena occur. Moreover, it is hardly possible to effect a reliable height measurement and height adjustment with the undefined indentation depth of the sensor into the pile in the case of such a sensing device. Deviations in the measured pile height depend upon the inertial forces and upon the conveying speed with regard to such a sensing device. Furthermore, the type of paper is an important factor. An imprecise height measurement results in an imprecise height adjustment and, accordingly, in problems with regard to effecting a reliable sheet acceptance and sheet conveyance. Furthermore, it is possible that the paper sheets may become damaged.

Especially at high speeds, for which such a drive demands a drive transmission of massive proportions for attaining a reliable drive formation, these dangers are increased. With such a conventional sensing device, it is therefore only possible with great difficulty to assure reliable sheet separation or singling and sheet conveyance at high speeds in spite of the use of a four-bar linkage drive which is especially advantageous for the guidance.

From U.S. Pat. No. 4,786,043, a sensor has become known wherein a governor foot is driven by a cam-controlled swivel lever and a four-bar linkage guide transmission. A guide bar around which a compression spring is wound is fastened to the four-bar linkage guide transmission. The guide bar is movably mounted in the swivel lever. The compression spring presses against the swivel lever. After the governor foot has been seated upon the pile surface, the high inertial forces of the solidly or massively formed swivel lever do no longer fully act upon the pile surface. However, the pivot lever which, after the moment of application, moves a short distance farther downwardly does compress the spring over the entire further downwardly driving drive region of the pivot lever and, as a result, the force exerted upon the pile by the spring via the feeler foot, after the feeler foot has been placed upon the pile surface, nevertheless rises further continuously over the downwardly driving drive cycle. The feeler foot, because of the sharply increasing spring force, is pressed undesirably strongly against the pile surface and, as a result, the top sheets can also be pressed inwardly in an undefined fashion. Reliable separation or singling and conveying of the sheets away therefrom, a reliable ascertainment of the pile height, and a reliable pile readjustment are also not assured with a sensor or feeler arrangement. Damage to the sheets is also possible there. Especially at high speeds, the strong inward pressures and the imprecision of the undulation are disadvantageous for an exact conveyance. U.S. Pat. No. 4,786,043 indeed shows a four-bar linkage guide transmission wherein the feeler foot is lowered from above for placement on the surface of the pile and, after the pile height is ascertained, is swiveled out of the pile region again so that the lifting suction devices can more rapidly engage the sheet, but reliable progress through the pile at very high speeds is unattainable with this mechanism for the reasons given hereinabove.

German Published Non-Prosecuted Patent Application DE-OS 32 18 565 discloses a suction lock with a guide member which can be moved vertically up and down and which engages in an oblong slot in a tongue with a contact pressure tab. The tongue is secured to a frame via a spring. By raising the guide member, the contact pressure tab is lifted vertically. Upon lowering, it is lowered vertically by spring force until the contact pressure tab touches the surface of the pile and presses against it under spring force. Upon further lowering of the guide member, no increasing force is exerted on the pile of sheets by the contact pressure tab, nevertheless, the purely vertical motion of the drive tab makes a fast, reliable progress through the pile by suction devices virtually impossible. For a reliable takeover of a sheet, the contact pressure tab must first move into a position above the level or height to which the lifting suction devices raise the sheets. Only after the sheet has been transported out of the stroke or lifting range of the contact pressure tab, for example, by means of pull or forwarding suction devices, can the contact pressure tab be lowered again to measure the height. This chronologically purely sequential course of the various operations consumes an undesirably large amount of time. This is a hindrance to conveying at high speeds. Moreover, the contact pressure tab, which always remains located above the top sheet because of the vertical motion, cannot, once the sheet is raised, firmly hold the sheet located underneath the raised sheet, so that this underlying sheet, as the upper sheet is transported away, may be ripped out of its position and the top sheet may sag, because of the effects of friction or flow phenomena. This imperils both height sensing and the acceptance and conveyance of the sheets. Furthermore, at high speeds, reliable progression through the pile is not possible with this kind of sensor.

It is accordingly an object of the invention to form a sensor for cyclically sensing the pile height of a feed pile of a sheet processing machine, particularly a printing machine, in such a way that reliable unpiling or unstacking is possible even at high speeds.

According to the invention, this object is attained by providing a feeder for cyclically sensing the height of a feed pile in a sheet processing machine through which sheets periodically travel, which includes a cyclically drivable drive cam, a lever drive transmission having a sensing roller spring-biased into continuous contact engagement with the cyclically drivable drive cam during travel of the sheets, a four-bar linkage guide transmission having two levers disposed above one another and being articulatingly affixed, at one respective end thereof, to a support frame, a coupler having a downwardly directed vertical extension, the levers, at respective other ends thereof, being articulatingly supported at a spaced distance from one another on the coupler, a feeler foot for sensing the height of the feed pile being secured to the vertical extension of the coupler, an entrainer stop secured to the lever drive transmission, a stop face formed on the guide transmission and disposed in a manner corresponding to the entrainer stop so as to be cyclically engageable thereby for raising the feeler foot, and spring means affixed at one bearing location thereof to the support frame and at another bearing location thereof to the guide transmission and having a spring force for pressing the stop face in a direction towards the entrainer stop. The lever drive transmission permits a reliable drive of the sensor. The four-bar linkage guide transmission with the levers disposed above one another and with the feeler foot secured to the coupler makes it possible to swivel the feeler foot inwardly and outwardly over a curved path, so that the feeler foot can be placed on the surface of the pile substantially vertically and can be swiveled back again reliably out of range of the pile for faster acceptance of sheets. As a result, the next sheet can be picked up or accepted faster by post-connected or down-line conveying means, such as lifting suction devices, due to which the length of a conveyance or feed cycle can be reduced. Placing the feeler foot vertically permits a shift-free, reliable placement of the feeler foot for the sheet located therebeneath, which is advantageous especially at high speeds. The coupling between the drive transmission and the four-bar linkage guide transmission, by means of an entrainer stop and a stop surface for lifting the feeler foot permits a reliable, fast lifting of the feeler foot in accordance with the drive control. At the instant the feeler foot is set in place, only the masses of the feeler foot and the guide transmission, and the spring force are operative. The decoupling of the drive transmission and the guide transmission permits a simple, easy construction of the guide linkage, so that the force exerted by the guide transmission and the feeler foot when the feeler foot is put in place can be minimized. The spring mounted fixed to the machine presses the feeler foot against the pile surface with a defined spring force when the feeler foot is seated in place. This spring force can be selected, by dimensioning the spring, so that, at the moment of placement, it is just strong enough that reliable sheet height measurement is yet possible. Although the mass or inertial forces and drive forces of the drive transmission, after the instant at which the feeler foot is put in place, further move the drive transmission onward in the same direction beyond the instant of the placement, the feeler foot stays on the pile surface with only the force exerted upon the feeler foot by the spring at the instant the feeler foot is put in place. Because, accordingly, after the instant it is put in place, the feeler foot rests on the upper sheet of the pile merely with a constant, minimized force, it is possible to avoid an undesirably strong inward pressure on the upper sheets of the pile. The sheet conveyance, height measurement and height readjustment thereby become more reliable, independently of speed. It is thus possible with such a sensor or feeler, even at high speeds, to assure reliable unpiling or unstacking of a feed pile. Moreover, after a sheet pile is lifted, the feeler foot can already be swiveled inwardly beneath the lifted sheet and placed on the pile located beneath the raised sheet. Once the raised sheet has been removed, the top sheet on the pile is reliably held in its position by the feeler foot, and its position cannot be varied by the sheet which has been conveyed away.

In accordance with another feature of the invention, the entrainer stop is pivotable about a pivot point of one of the two levers of the guide transmission, the pivot point being fixed to the support frame. In such a construction, the stop surface can be made especially small and simple, because the entrainer stop, in any position of the contact engagement with the stop surface, assumes the same position relative to the stop surface. Inaccuracies as a result of manufacturing and motion tolerances between the stop surface and the entrainer stop, which have a negative effect upon the feeler or sensor motion, are thereby reducible.

An especially simple and reliable drive is made possible by the construction in accordance with a further feature of the invention, wherein the lever drive transmission is a four-bar linkage drive transmission having two levers, respectively, pivotally supported, at one end of a respective lever arm thereof, on a pivot point fixed to the support frame; and a coupler to which the two levers are pivotally connected in common, at a spaced distance from one another at the other respective end thereof; the fixed pivot point of a first one of the two levers being a fixed pivot point of a first one of the two levers of the guide transmission, the entrainer stop being disposed on the first lever of the drive transmission, and the corresponding stop face being disposed on the first lever of the guide transmission. The number of articulating locations can be minimized while maintaining the advantages of the four-bar linkage drive for guidance, drive and mass distribution purposes.

In accordance with an added feature of the invention, the guide transmission is formed with a sensing surface having a position which is variable as a function of the height of the feeler foot, and a sensor arrangement is fixed to the support frame for ascertaining the position of the sensing surface, the sensor arrangement being in communication with an evaluation and control device for readjusting the pile height. In a preferred embodiment, the feeler foot is secured to the extension of the coupler so that it is adjustable in height. This enables a simple, exact setting and readjustment of the feeler foot. Reliable unpiling or unstacking can thus be assured in a simple manner.

In accordance with a preferred embodiment of the invention, the spring support secured to the guide transmission is disposed on the other one of the two levers of the guide transmission.

In accordance with another preferred embodiment of the invention, the sensing roller is rotatably supported on the second one of the two levers of the four-bar drive linkage.

In accordance with a third preferred embodiment of the invention, the sensing face is formed on one of the two levers of the guide transmission.

In accordance with a concomitant feature of the invention, the feeler foot is secured to the extension of the coupler so as to be adjustable in height.

The invention is described in detail below in terms of the embodiments shown in FIGS. 1 to 3.

Figure 1:
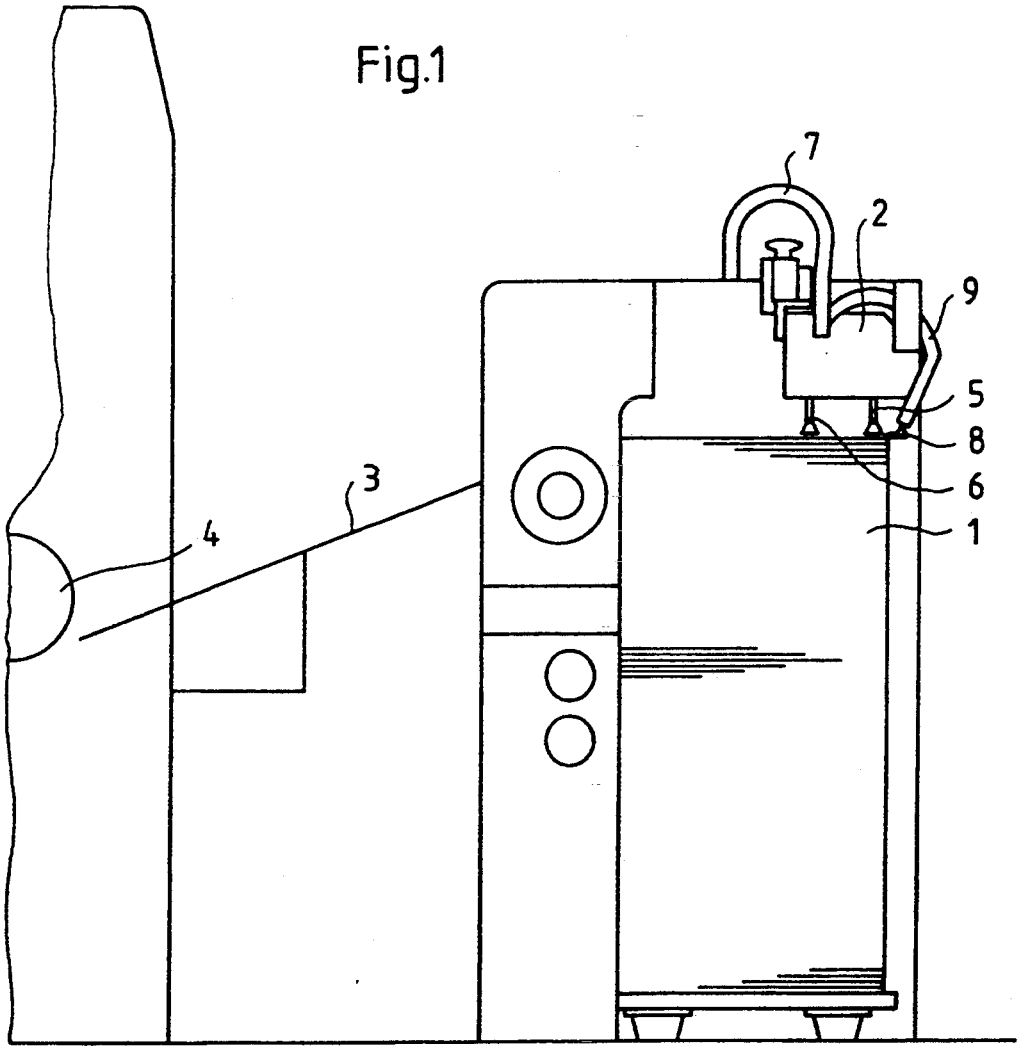
Figure 3A:
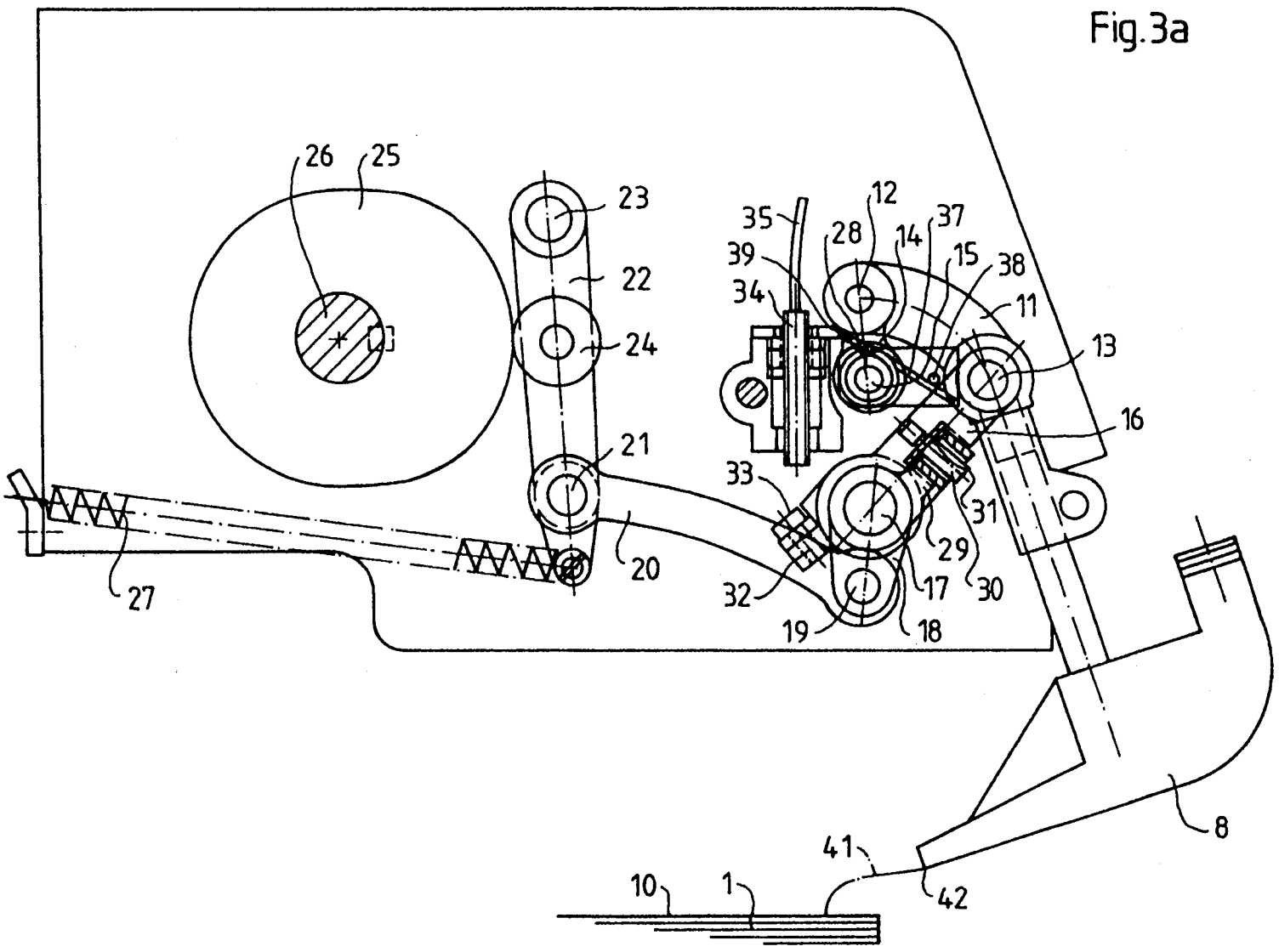
Figure 3B:
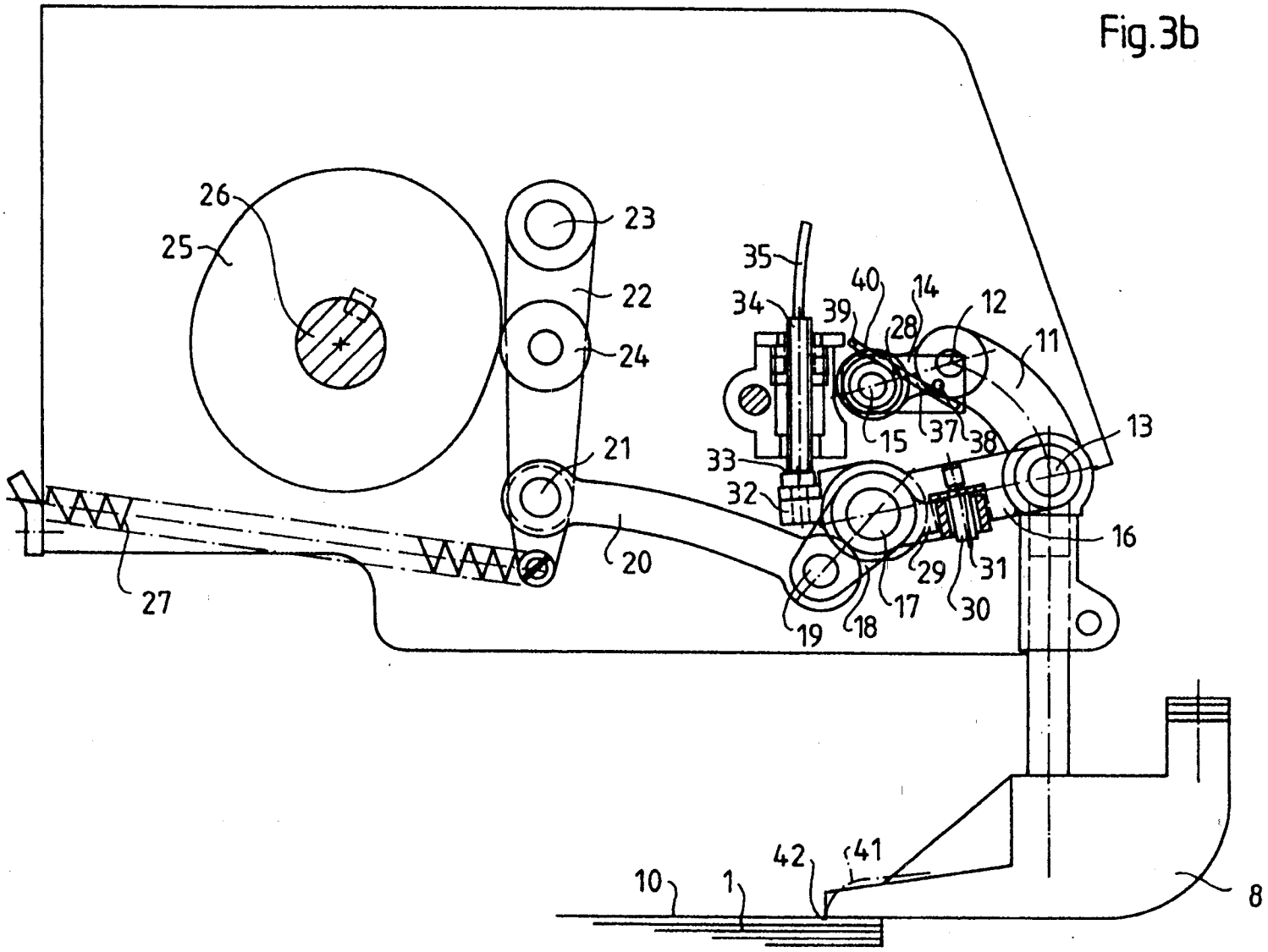
Figure 3C:
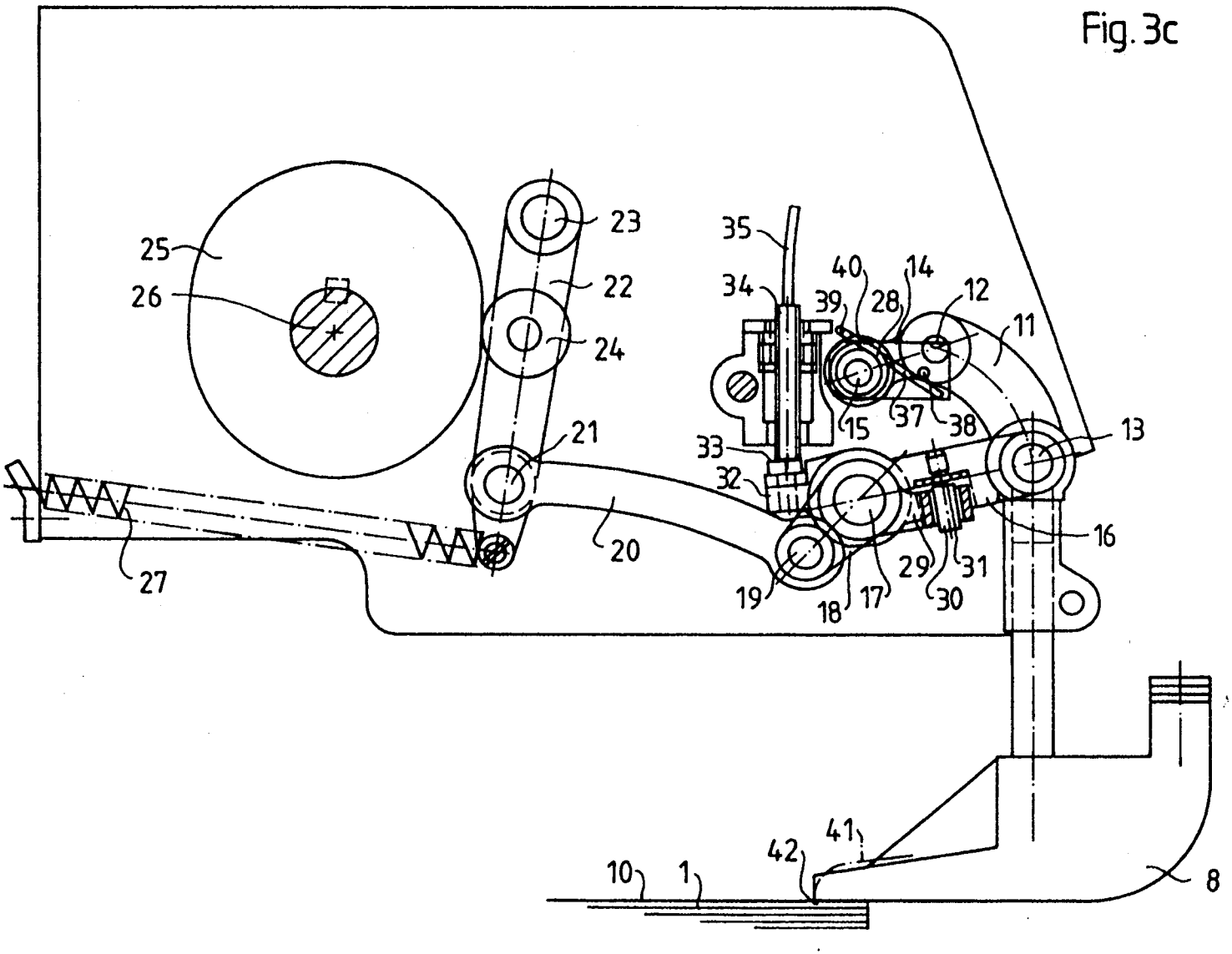

Herein shown are:

FIG. 1, a schematic overview of a sheet-fed printing machine feeder, with a suction head and feeler foot;

FIG. 2, a schematic illustration of a feeler foot according to the invention;

FIGS. 3*a*, 3*b* and 3*c* are diagrammatic elevational views of the feeler foot drive in different operating phases thereof.

FIG. 1 shows a feeder of a sheet-fed rotary offset printing machine, wherein in a known manner a topmost sheet of a feed pile 1 is raised by a lifting suction device 5 of a suction head 2 and is guided forwardly by following or down-line pull or forwarding suction devices 6 of the suction head 2, out of the range of the suction head, to non-illustrated conveyor means in the vicinity of the feeder table. Once the sheet has been taken over by the non-illustrated feed means, the sheet is transferred across the feeder table 3 to gripper bars of the pre-gripper drum 4 which, in a known manner, transfer it to a non-illustrated printing cylinder. The instant the topmost sheet has been lifted from the pile by the lifting suction device 2, a feeler foot 8 is swiveled underneath the raised sheet into the region above the feed pile 1 and lowered onto the feed pile 1 far enough so that the feeler foot enters into contact engagement with the top sheet of the feed pile 1.

As shown in FIG. 2, the feeler foot 8 is secured in a vertically downwardly directed extension of a coupler 11. The coupler 11 is pivotally connected to a lever 14 by an upper articulation or joint 12 and to a lever 16 by a lower articulation or joint 13. The lever 14 is pivotally supported by its other end in a pivot bearing 15 fixedly attached to the machine. When the feeler foot 8 is lowered substantially parallel to the lever 14, the lever 16 is aligned and is pivotally connected in a pivot bearing 17 fixedly attached to the machine. A lever 18 is connected in the pivot bearing 17 concentrically with the pivot axis of the lever 16 so as to be pivotable about the pivot bearing 17. On its lower end, the lever 18 is pivotally connected by a joint 19 to a coupler 20, which in turn is pivotally connected at a joint 21 to a lever 22. The lever 22 is pivotally supported in a pivot bearing 23 fixed to the machine. A sensing roller 24 is rotatably supported on the lever 22 between the joint 21 and the pivot bearing 23. The lever 22 is engaged by a tension spring 27, which is supported, fixed to the machine, by its other spring bearing. The spring 27 keeps the sensing roller 24 in permanent contact engagement with the outer contour of the radial cam 25. The radial cam 25 is secured to a control shaft 26 which extends transversely to the sheet conveying direction and is rotatably supported in a conventional non-illustrated manner in the suction head frame. The control shaft 26 is drive-connected with the machine drive in a known manner.

A stop screw 30 is screwed into a lever arm 29 of the lever 18, below the lever 16. This stop screw 30 is formed with its upper face, which is directed towards the lever 16, as a stop face. Opposite thereto, the lever 16 is provided with a corresponding stop face 31. A spiral spring 28 is wound around the pivot bearing 15 on the lever 14 and is supported by one spring support thereof on a stop 40 fixed to the machine and by its other spring support on the lever 14. The spiral spring 28 presses the lever arm 14 downwardly.

After the topmost sheet of paper has been taken from the feed pile 1 by the lifting suction device 5, the sensing roller 24 and thus the lever 22 are pivoted away, out of the position in FIG. 3*a*, about the pivot bearing 23 as a result of the decreasing spacing between the sensing point of the contour of the face of the curve 25 and the feeler foot, due to the rotation of the control shaft 26 and hence of the control cam 25 because of the spring force of the spring 27. As a result, via the coupler 20, the lever 18 and hence the stop screw 30 are swiveled about the pivot bearing 17, so that the stop screw 31 is swiveled downwardly. By the spring force of the spring 28, the lever 14, the coupler 11 and the lever 16 are moved downwardly with the swiveling of the lever 14 about the pivot bearing 15 and of the lever 16 about the pivot bearing 17, the stop face 31 of the lever 16 being in permanent contact engagement with the stop screw 30. In this downward motion, the front or leading edge 42 of the feeler foot 8 describes a curve 41; in other words, it is initially swiveled inwardly virtually horizontally from a region outside the feed pile into the range of the feed pile, beneath the non-illustrated sheet which has already been removed, and then changes to an essentially vertical range of motion, in which the feeler foot is lowered onto the surface of the pile. This downward motion continues until such time as the feeler foot, as shown in FIG. 3*b*, rests on the surface of the feed pile 1. After the placement of the feeler foot 8 on the surface of the feed pile 1, the control shaft 26 is rotated onwardly in the same direction, due to which, the drive transmission comprising the levers 22, 20 and 18, further following the contour of the cam 25, is moved onward as described above, so that the stop screw 30 is lowered even farther, and the feeler foot 8 remains on the surface of the feed pile solely due to the spring force of the spring 28. The feeler foot 8, the coupler 11, and the levers 14 and 31 are accordingly not further moved. The stop screw 30 as a result moves downwardly away from the stop face 31 of the lever 16, as shown in FIG. 3*c*. Via a sensing face 33 of a lever arm 32 on the lever 31, the distance between the sensor and the measuring face 33 is ascertained by a contactless sensor 34. The sensor 34 communicates via an electrical connection 35 with a measurement and evaluation apparatus, such as a computer. From the distance between the sensor 34 and the measuring face 33, the computer ascertains the instantaneous height of the feed pile in a known manner. The non-illustrated sheet of paper previously raised by the lifting suction device 5 is transferred by pull or forwarding suction devices 6 to non-illustrated conveyor means of the feeding table. The spring 28 is dimensioned so that the feeler foot rests with just enough force on the feeder pile that height measurement is yet possible. The feeler foot prevents the topmost sheet 10 present at that instant of time in the feed pile 1, whereon the feeler foot is resting, from being carried along by the sheet which has already been lifted and is being carried away by the pull or forwarding suction devices.

To improve this separation, a blower nozzle 36 is mounted on the feeler foot 8 and, via a blown air delivery line 9, is connected to blowing air under cyclical control. As a result, air is blown beneath the raised sheet. This affords a better prevention of contact engagement with the pile.

The instant the sensing roller 24 has reached the point on the contour of the cam 25 which is spaced the least distance from the control shaft 26, the contact screw 30 is then no longer lowered any further. As the control cam continues to rotate, the distance between the contour of the cam 25 and the control shaft 26 increases again, so that the sensing roller 24 and thus the lever 22 are again pivoted away from the control shaft 26. As a result, the lever 18 is swiveled around the pivot shaft 17 in such a manner that the stop screw 30 moves upwardly. The instant the stop face of the stop screw 30 comes into contact engagement with the stop face 31 of the lever 16, the stop screw 30, via its stop face and the stop face 31 of the lever 16, carries the lever 16 upwardly along with it, swiveling about the pivot axis 17. As a result, the coupler 11 and the lever 14 are likewise lifted, so that the lever 14 is pivoted upwardly about the pivot bearing 15, counter to the spring force of the spring 28. In the process, the feeler foot 8 lifts substantially vertically away from the surface of the pile and is pivoted out of the region above the pile back into a position in a region outside the pile. Such a position is shown in FIG. 3*a*, for example. The lifting suction device 5 is cyclically lowered again in a known manner in order to take the next sheet from the pile. The lifting suction device 5 and the pull or forwarding suction device 6 are supplied with suction in a known, controlled manner via the suction head, with the aid of a suction supply line 7.

Instead of the spiral spring 28 as shown in FIG. 2, a spiral spring may also be wound about the pivot axis 15. One arm of the spring is braced against a pin 38 secured in the suction-head housing, and the other arm of the spring is braced against a pin 39 secured in the lever arm.

It is also conceivable for the feeler foot 8 to be displaceably secured in the coupler 11, as shown in FIG. 3. With known adjusting and locking means, not shown, the feeler foot may thus be precisely adjusted in its height. The pile height ascertained by the computer is used in a known manner to cyclically readjust the pile height. For example, the computer can simultaneously produce a control signal, which corresponds to the measured value, for the drive means of the lifting drive. Separating the drive transmission from the guide transmission makes a simple, lightweight construction for the guide linkage and the feeler foot possible. To a maximal extent, the parts may be made of plastic and/or aluminum.

We claim:

1. A feeder for cyclically sensing the height of a feed pile in a sheet processing machine through which sheets periodically travel, includes a cyclically drivable drive cam, a lever drive transmission having a sensing roller spring-biased into continuous contact engagement with the cyclically drivable drive cam during travel of the sheets, a four-bar linkage guide transmission having two levers disposed above one another and being articulatingly affixed, at one respective end thereof, to a support frame, a coupler having a downwardly directed vertical extension, the levers, at respective other ends thereof, being articulatingly supported at a spaced distance from one another on the coupler, a feeler foot for sensing the height of the feed pile being secured to the vertical extension of the coupler, an entrainer stop secured to the lever drive transmission, a stop face formed on the guide transmission and disposed in a manner corresponding to the entrainer stop so as to be cyclically engageable thereby for raising the feeler foot, and spring means affixed at one bearing location thereof to the support frame and at another bearing location thereof to the guide transmission and having a spring force for pressing the stop face in a direction towards the entrainer stop.

2. A feeler in accordance with claim 1, wherein the entrainer stop is pivotable about a pivot point of one of the two levers of the guide transmission, the pivot point being fixed to the support frame.

3. A feeler in accordance with claim 2, wherein the spring support secured to the guide transmission is disposed on the other one of the two levers of the guide transmission.

4. A feeler in accordance with claim 1, wherein the lever drive transmission is a four-bar linkage drive transmission having two levers, respectively, pivotally supported, at one end of a respective lever arm thereof, on a pivot point fixed to the support frame; and a coupler to which the two levers are pivotally connected in common, at a spaced distance from one another at the other respective end thereof; the fixed pivot point of a first one of the two levers being a fixed pivot point of a first one of the two levers of the guide transmission, the entrainer stop being disposed on the first lever of the drive transmission, and the corresponding stop face being disposed on the first lever of the guide transmission.

5. A feeler in accordance with claim 4, wherein the sensing roller is rotatably supported on the second one of the two levers of the four-bar drive linkage.

6. A feeler in accordance with claim 1, wherein the guide transmission is formed with a sensing surface having a position which is variable as a function of the height of the feeler foot and including a sensor arrangement fixed to the support frame for ascertaining the position of the sensing surface, the sensor arrangement being in communication with an evaluation and control device for readjusting the pile height.

7. A feeler in accordance with claim 6, wherein the sensing face is formed on one of the two levers of the guide transmission.

8. A feeler in accordance with the features of claim 1, wherein the feeler foot is secured to the extension of the coupler so as to be adjustable in height.

* * * * *